US007204549B1

(12) United States Patent
Zeng

(10) Patent No.: US 7,204,549 B1
(45) Date of Patent: Apr. 17, 2007

(54) FOLDABLE RECREATIONAL CHAIR

(76) Inventor: Chun-Sian Zeng, No. 3, Ting Hsi Hsin, Lu Man Tsun, Chuchi Hsiang, Chiayi Hsien (TW)

( * ) Notice: Subject to any disclaimer, the term of this patent is extended or adjusted under 35 U.S.C. 154(b) by 0 days.

(21) Appl. No.: 11/380,263

(22) Filed: Apr. 26, 2006

(51) Int. Cl.
*A47C 4/28* (2006.01)

(52) U.S. Cl. ..... 297/45; 297/59

(58) Field of Classification Search ..... 297/45, 297/43, 42, 59, 452.2, 440.11, 16
See application file for complete search history.

(56) References Cited

U.S. PATENT DOCUMENTS 647,171 A * 4/1900 Wiles ..... 108/118
2,473,090 A * 6/1949 Becker ..... 297/45
2,689,602 A * 9/1954 Morgan ..... 297/45
2,702,586 A * 2/1955 Borgfeldt ..... 297/440.11
4,258,951 A * 3/1981 Groom ..... 297/16.2
6,883,862 B1 4/2005 Yao

* cited by examiner

*Primary Examiner*—Milton Nelson, Jr.
(74) *Attorney, Agent, or Firm*—Alan D. Kamrath; Nikolai & Mersereau, P.A.

(57) ABSTRACT

A foldable recreational chair includes a leg assembly and a seat. The leg assembly includes two front legs, two rear legs, an upper board, a lower board, the same number of pivots as the number of the front and rear legs, and the same number of locking members as the number of the front and rear legs. The seat is made of flexible material and is arranged at four corners thereof with four assembling pockets for receiving an upright end of the respective front and rear legs. The locking members serve to fix the upper board and the lower board to a transverse end of the respective front and rear legs, and the upright end of the respective front and rear legs is inserted in the assembling pockets of the seat.

9 Claims, 11 Drawing Sheets

FOLDABLE RECREATIONAL CHAIR

BACKGROUND OF THE INVENTION

1. Field of the Invention

The present invention relates to a foldable recreational chair and, more particularly, to a foldable chair whose width and the length can be substantially reduced when the front and rear legs are closed together and, thus, the packaging, the storage space and the transport cost of the chair will be reduced.

2. Description of the Prior Art

U.S. Pat. No. 6,883,862 discloses a recreational chair including a first leg frame, a second leg frame, and a seat frame. When unfolding the chair, the user can pull the chair frame upward, making the locking member disengage from the first and the second leg frames. Then, the user can push the seat frame adjacent the first leg frame downward, so that the two leg frames are closed. Thus, the chair is folded.

The above-mentioned chair is only reduced in thickness after being folded. However, its width doesn't change. Therefore, the packaging and the storage space of the chair are not reduced too much, and the resultant reduction in production cost is not great.

The present invention has arisen to mitigate and/or obviate the afore-described disadvantages.

SUMMARY OF THE INVENTION

The primary objective of the present invention is to provide a foldable chair whose width and the length can be substantially reduced when the front and rear legs are closed together. Thus, the packaging, the storage space and the transport cost of the chair will be reduced.

A foldable recreational chair in accordance with the present invention comprises a leg assembly and a seat. The leg assembly includes two front legs, two rear legs, an upper board, a lower board, the same number of pivots as the number of the front and rear legs, and the same number of locking members as the number of the front and rear legs. The seat is made of flexible material and is arranged at four corners thereof with four assembling pockets for receiving an upright end of the respective front and rear legs. The locking members serve to fix the upper board and the lower board to a transverse end of the respective front and rear legs, and the upright end of the respective front and rear legs is inserted in the assembling pockets of the seat.

The present invention will be more clear from the following description when viewed together with the accompanying drawings, which show, for purpose of illustrations only, the preferred embodiment in accordance with the present invention.

DETAILED DESCRIPTION OF THE PREFERRED EMBODIMENTS

Referring to FIGS. 1–4, a foldable recreational chair in accordance with a preferred embodiment of the present invention includes a leg assembly 1 and seat 2.

Figure 1:
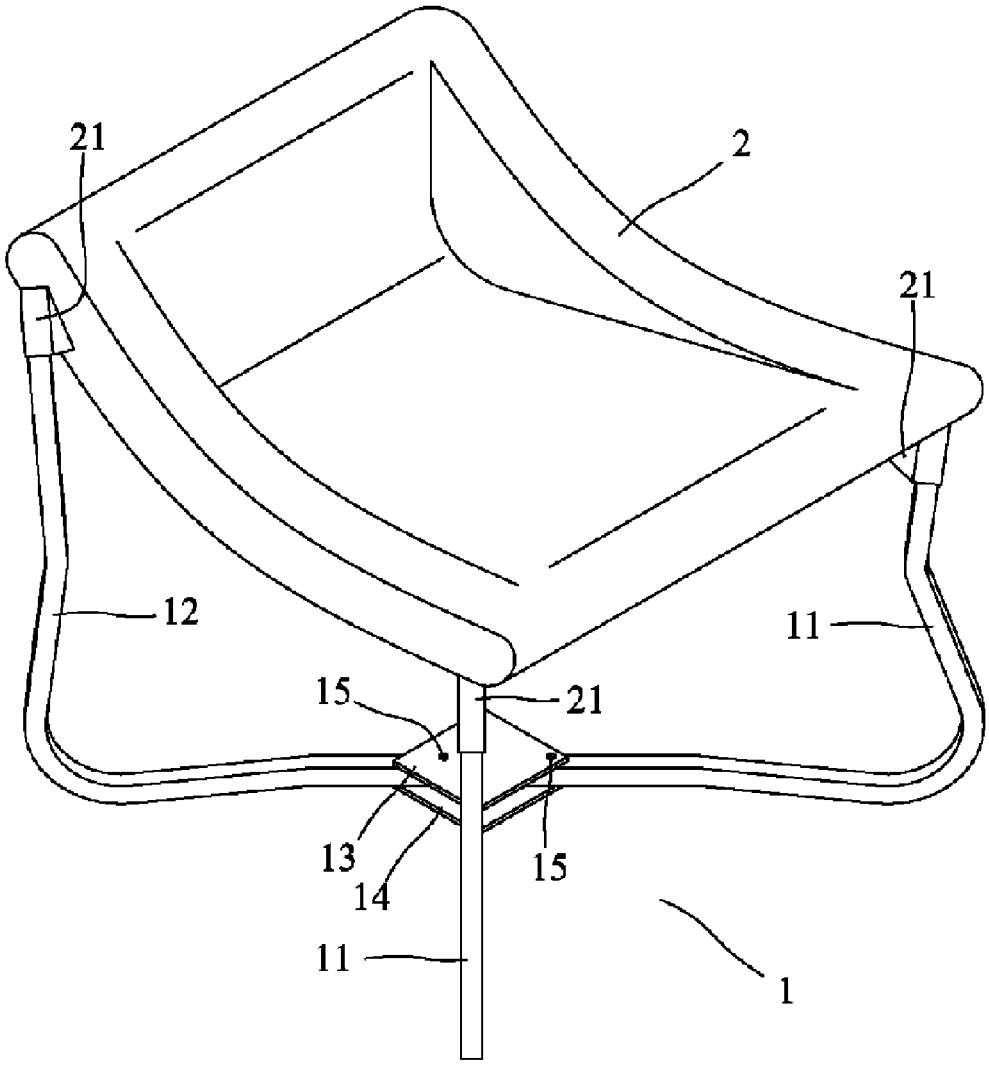
FIG. 1 is a perspective assembly view showing a seat and a leg assembly in accordance with the present invention.
Figure 2:
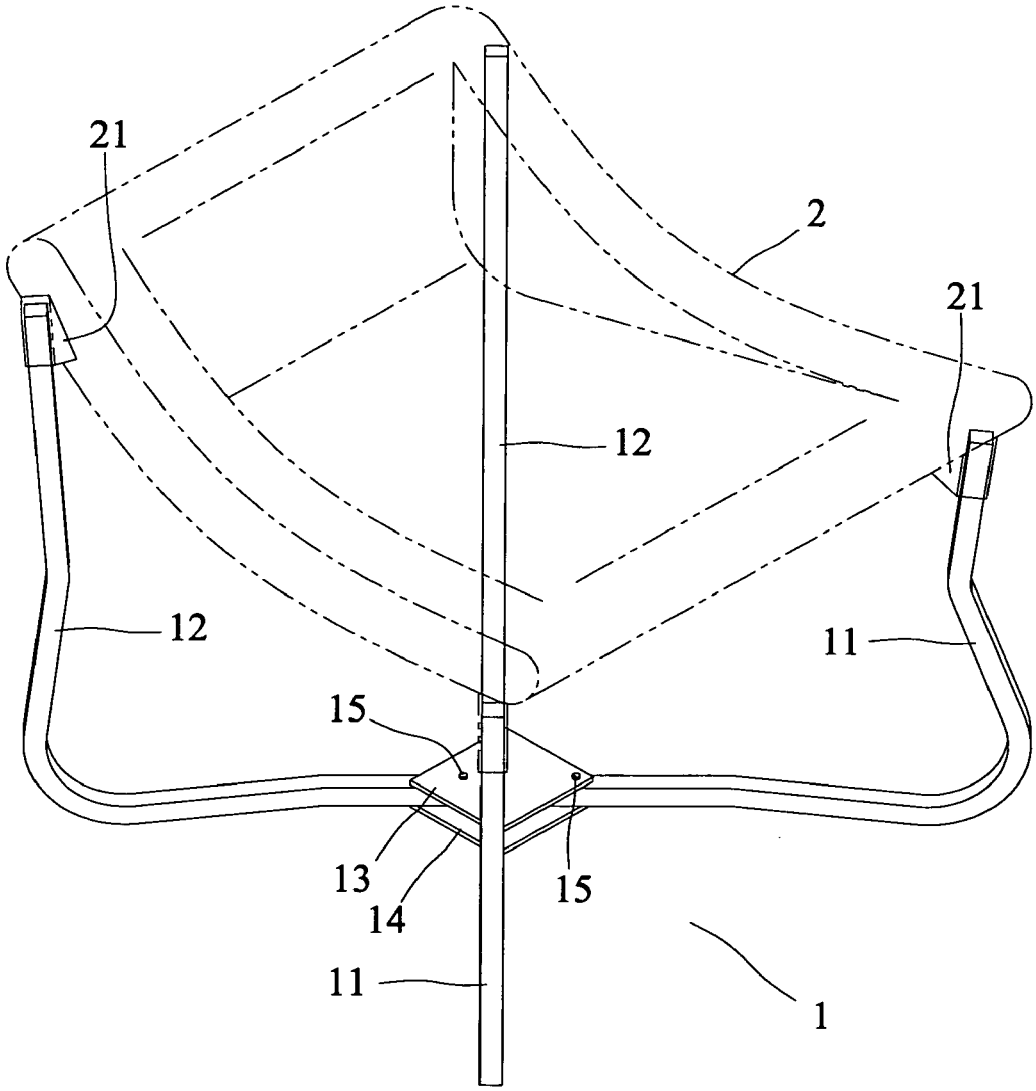
FIG. 2 is a perspective view showing the unfolded condition of the leg assembly in accordance with the present invention.
Figure 3:
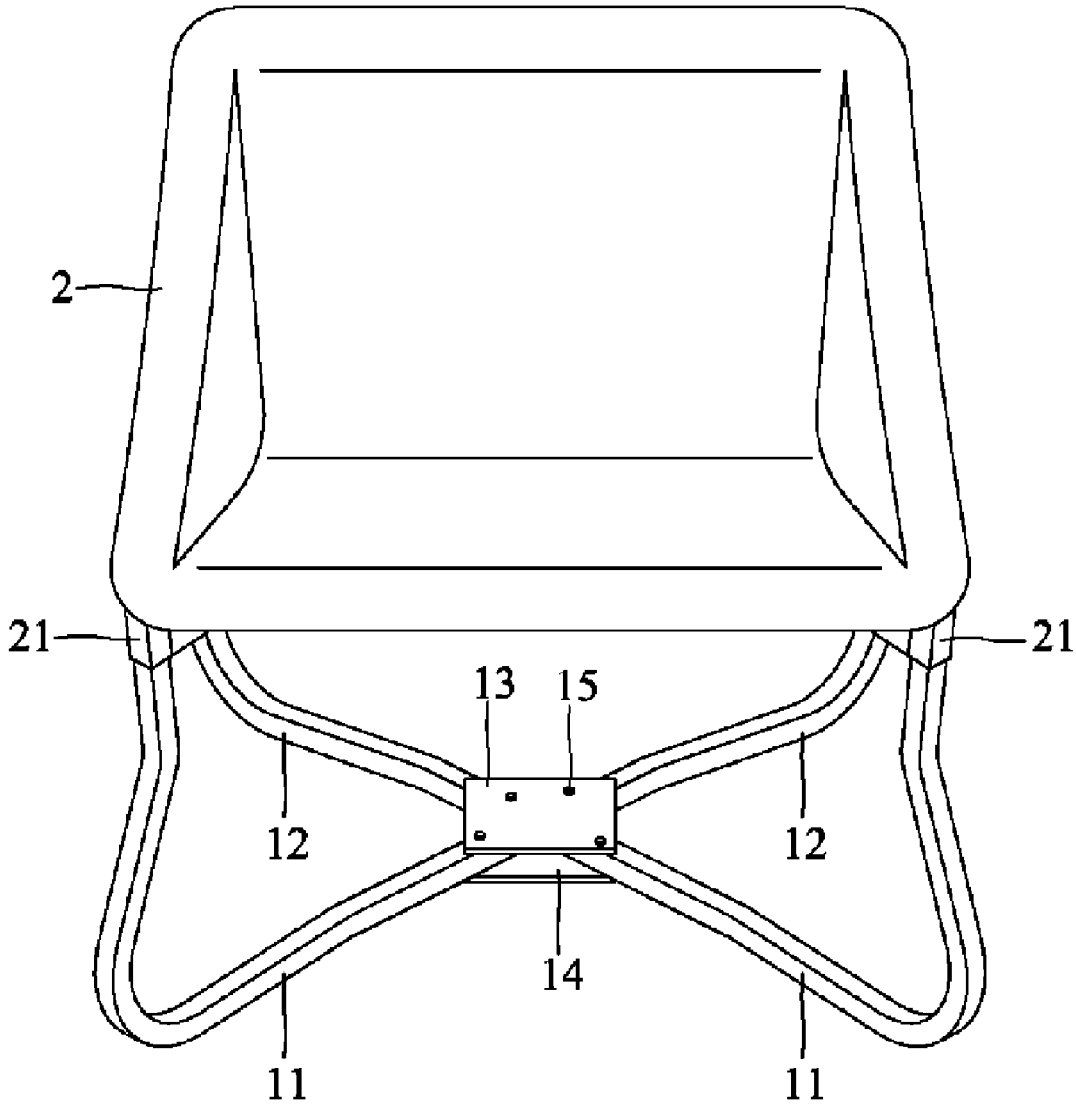
FIG. 3 is a front assembly view showing the seat and the leg assembly in accordance with the present invention.
Figure 4:
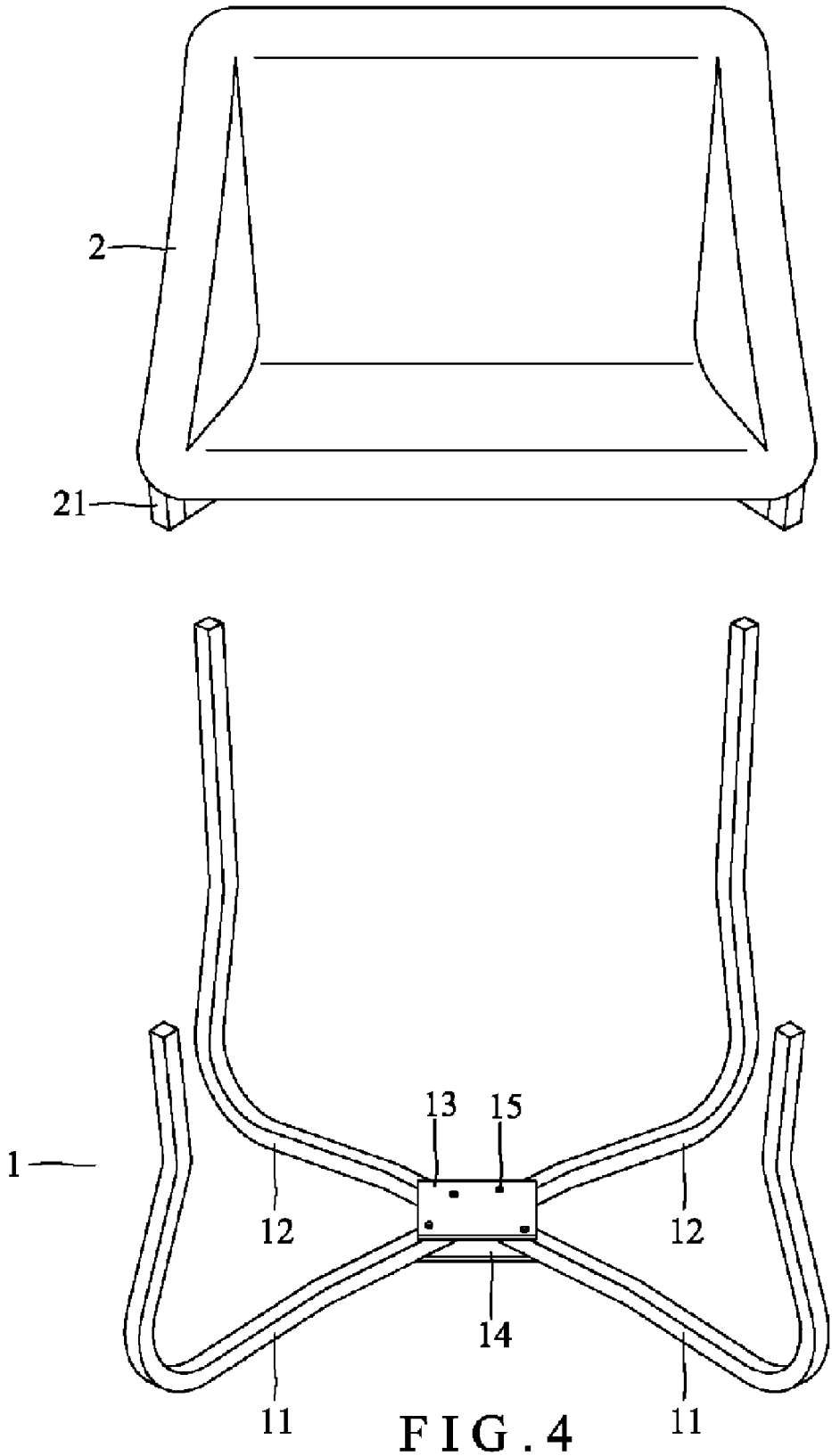
FIG. 4 is an exploded view showing the seat and the leg assembly in accordance with the present invention.
Figure 6:
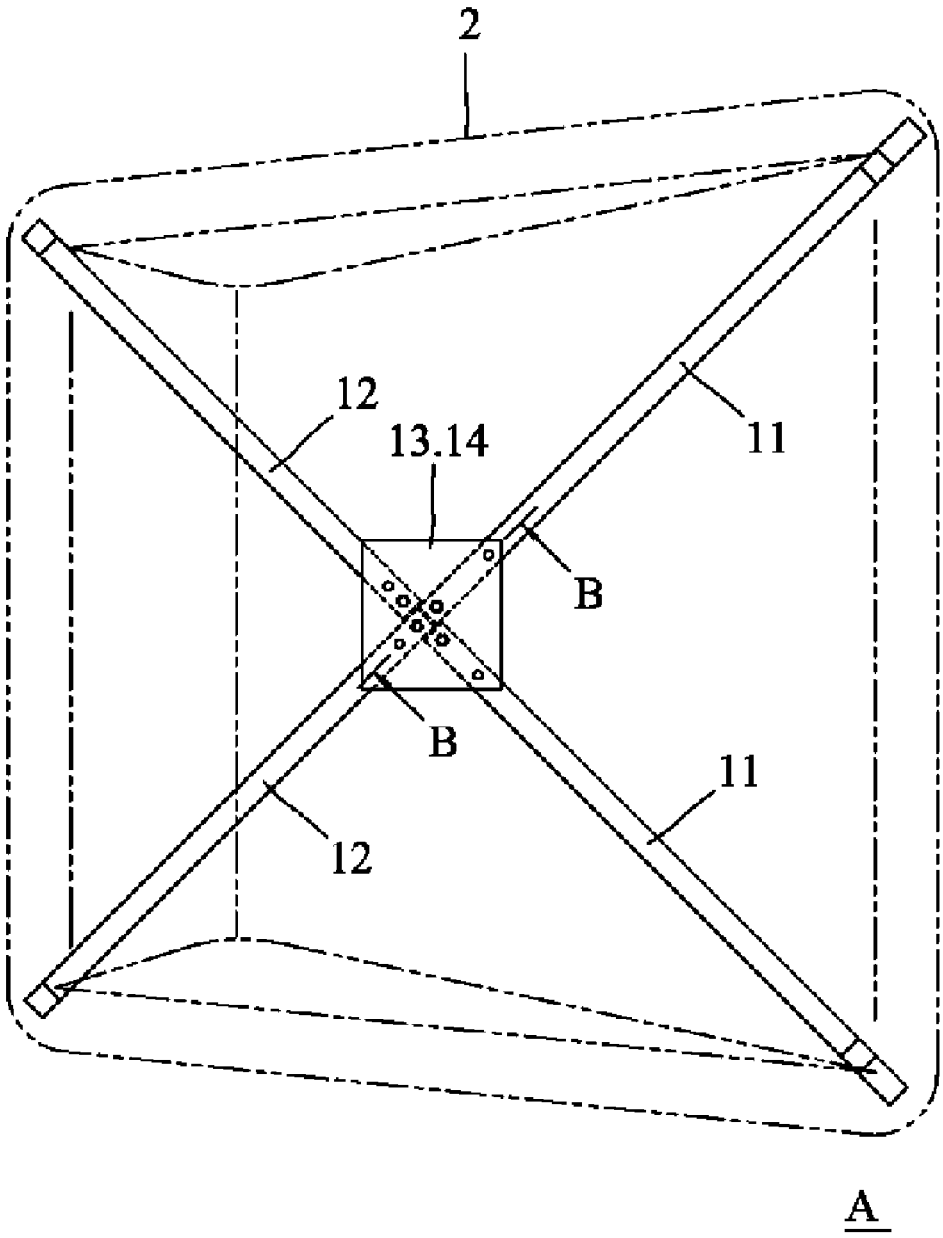
FIG. 6 is a cross section view taken along the direction A of FIG. 5.
Figure 7:
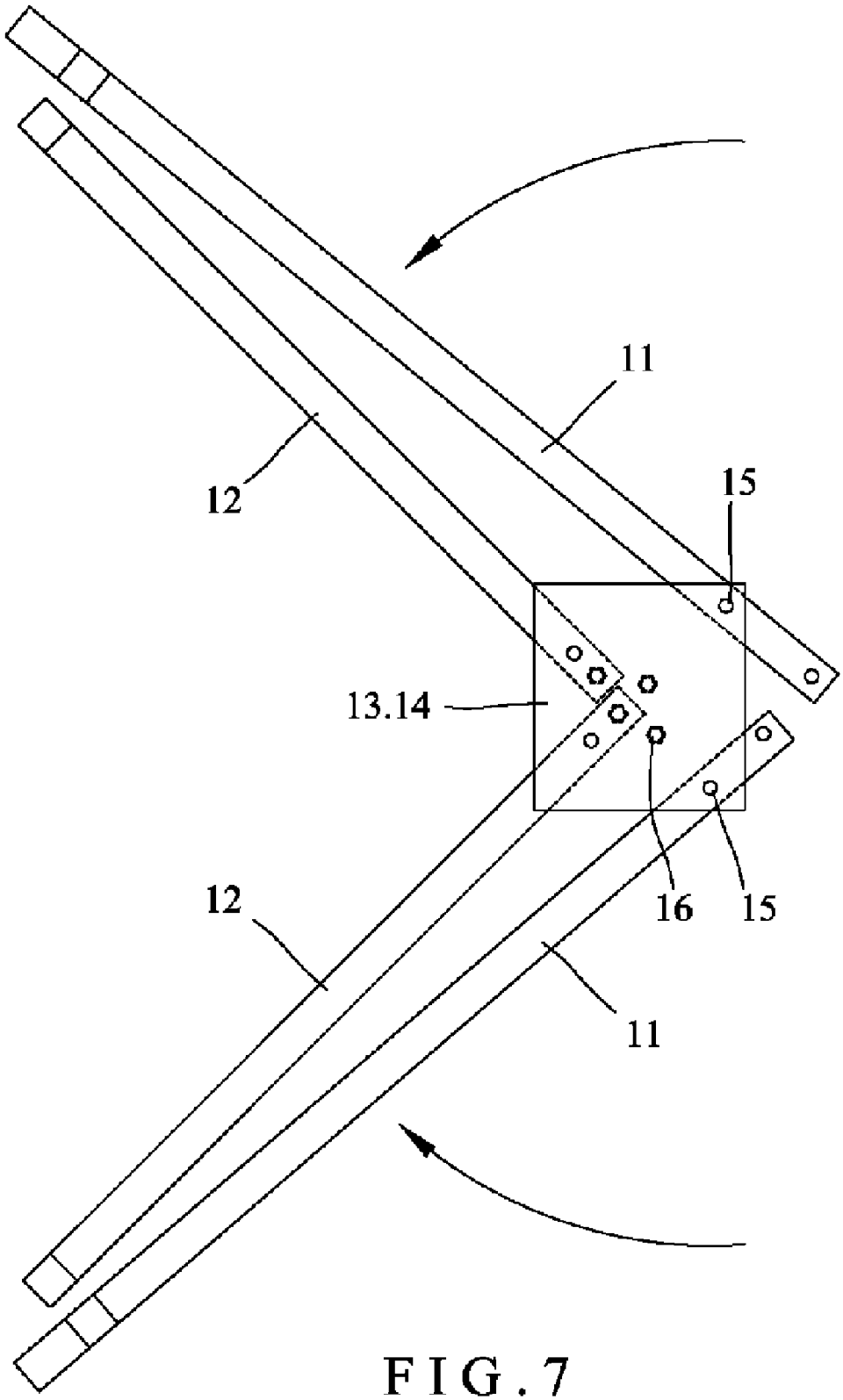
FIG. 7 is a top view showing the folded condition of the leg assembly in accordance with the present invention.
Figure 8:
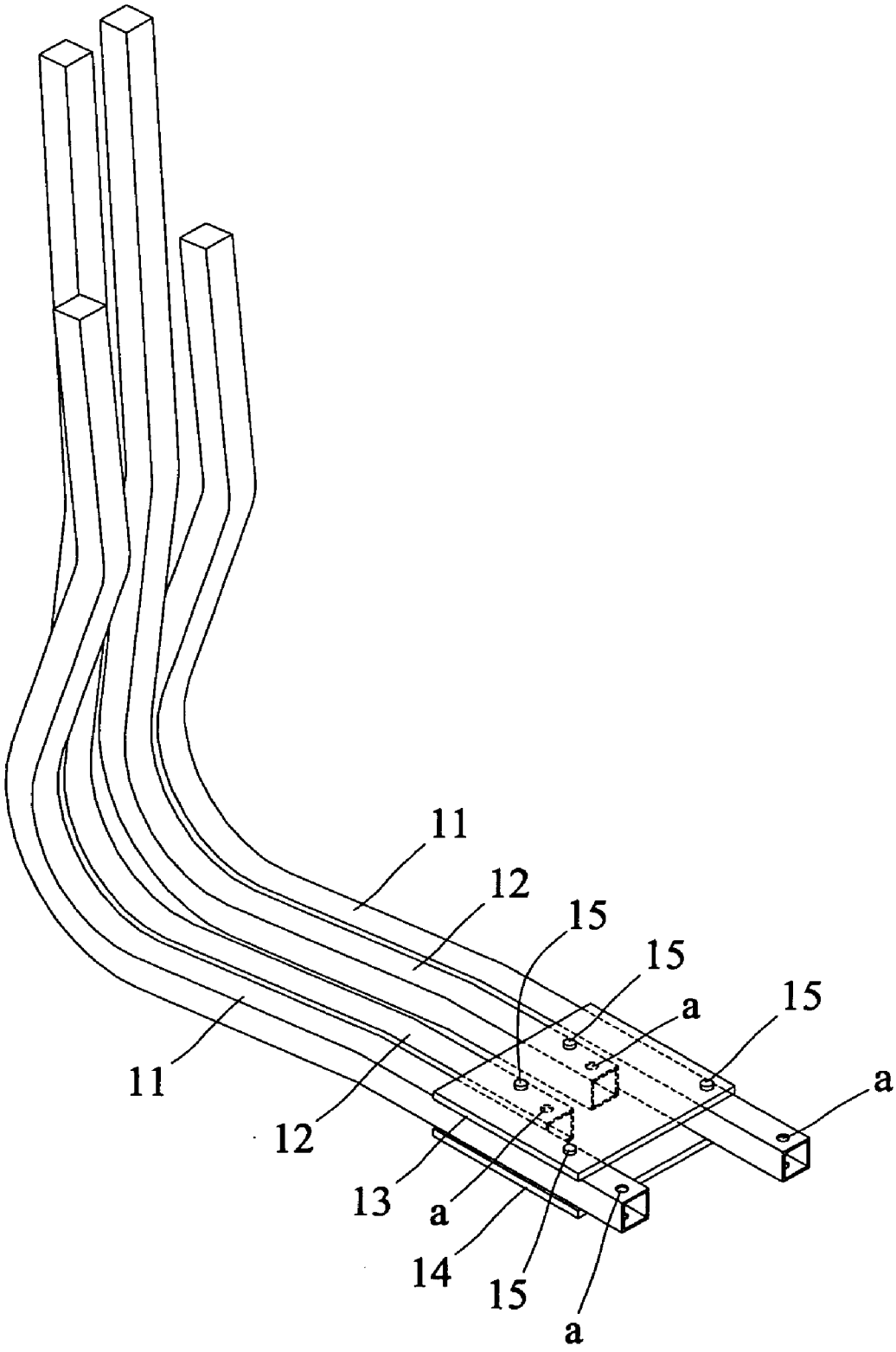
FIG. 8 is a top perspective view showing the folded condition of the leg assembly in accordance with the present invention.
Figure 9:
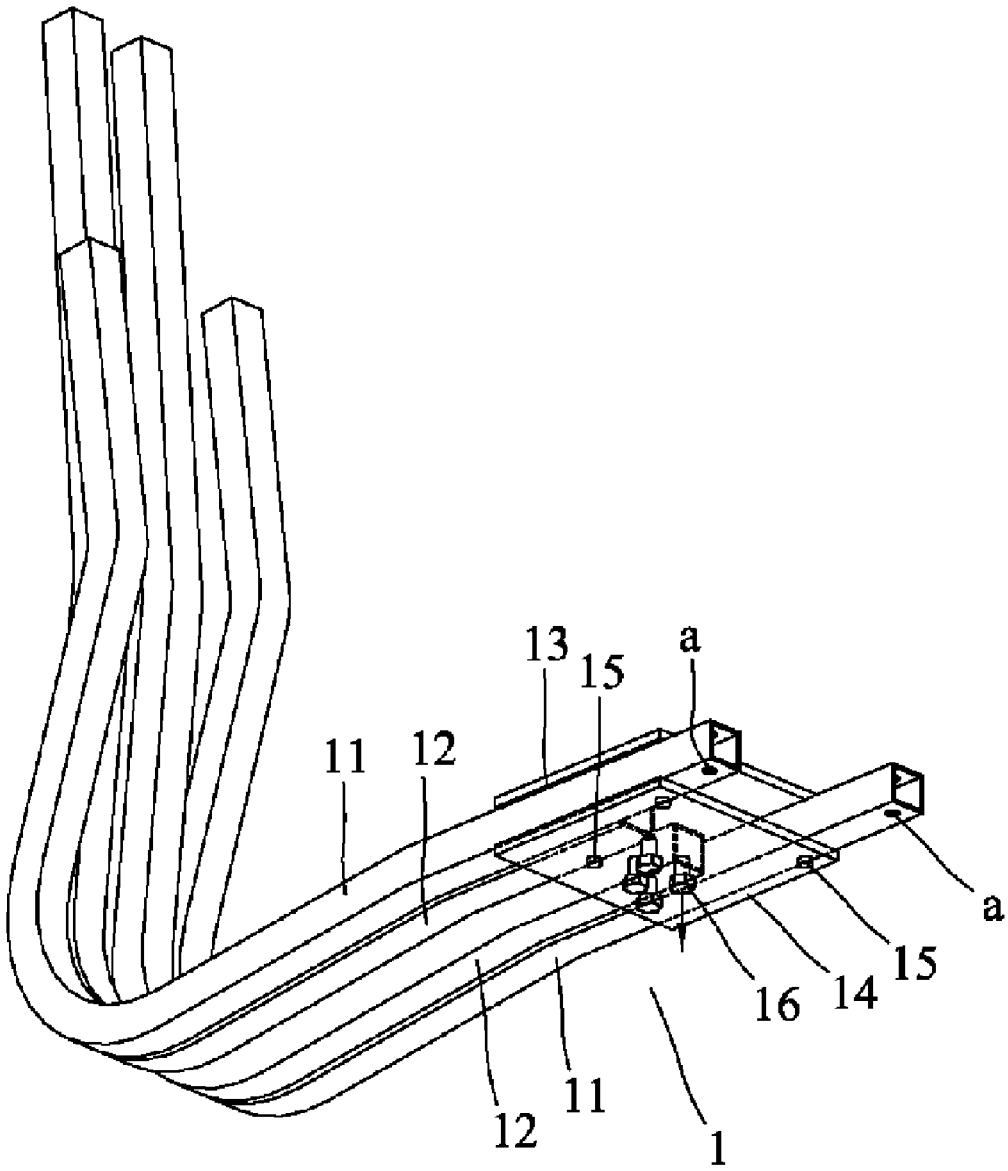
FIG. 9 is a bottom perspective view showing the folded condition of the leg assembly in accordance with the present invention.
Figure 10:
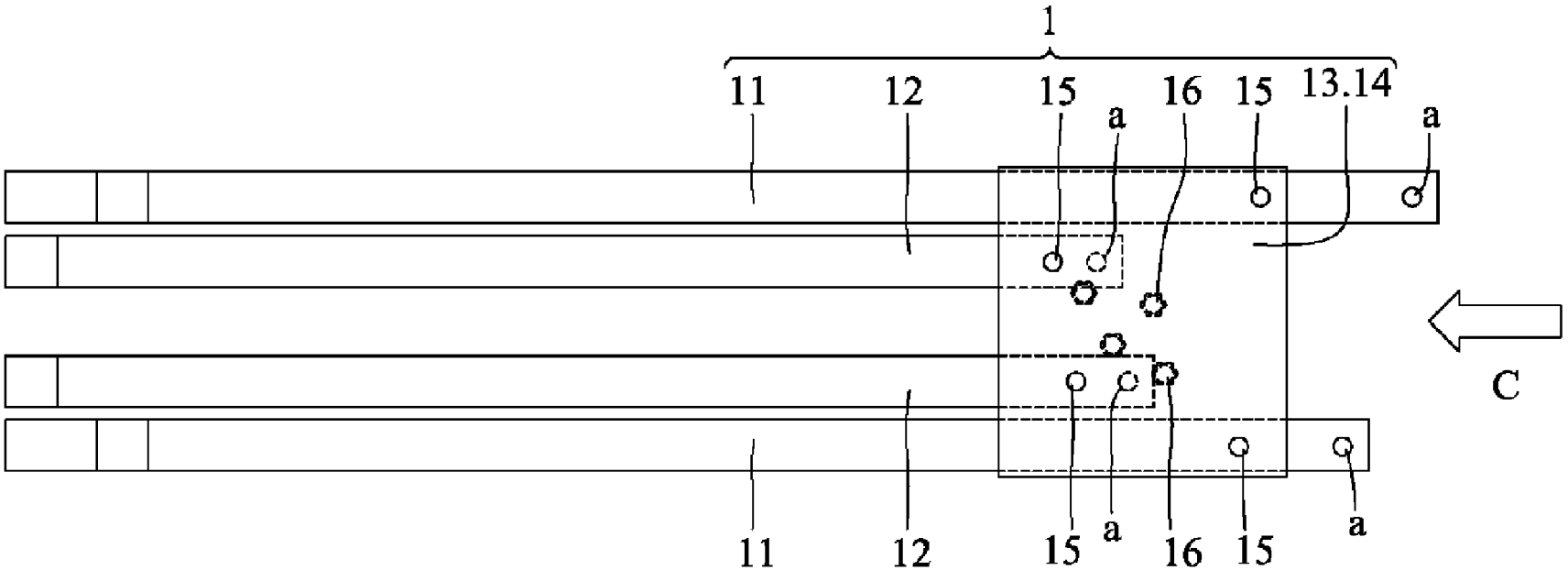
FIG. 10 is a top view showing the folded condition of the leg assembly in accordance with the present invention.

The leg assembly 1 as particularly shown in FIG. 4 includes two front legs 11, two rear legs 12, an upper board 13, a lower board 14, the same number of pivots 15 as the number of front and rear legs 11 and 12, and the same number of locking members 16 (as shown in FIGS. 4, 6, and 9) as the number of the front and rear legs 11 and 12. Each of the front legs 11 is a L-shaped tube. A hole a is formed in the transverse end of each front leg 11, as shown in FIG. 8. The pivot 15 is inserted in each of the front legs 11 and is located adjacent to the hole a. Likewise, each of the rear legs 12 is a L-shaped tube. A hole a is formed in the transverse end of each rear leg 12. The upper board 13 is disposed on the transverse ends of the front and rear legs 11 and 12, and the top ends of the respective pivots 15 are inserted in the top surface of the upper board 13. The lower board 14 is fixed beneath the transverse ends of the front and rear legs 11 and 12, and the lower ends of the respective pivots 15 are inserted in the bottom surface of the lower board 14. The pivots 15 are used to fix the upper and lower boards 13, 14 to the front and rear legs 11 and 12. The locking members 16 are disposed in the bottom surface of the lower board 14 in such a manner that the inner ends of the locking members 16 are inserted in the respective holes a of the front and rear legs 11 and 12.

The seat 2 is made of flexible material, and arranged at each of the four corners of the seat 2 is an assembling pocket 21 to receive the upright end of the respective front and rear legs 11 and 12.

Figure 5:
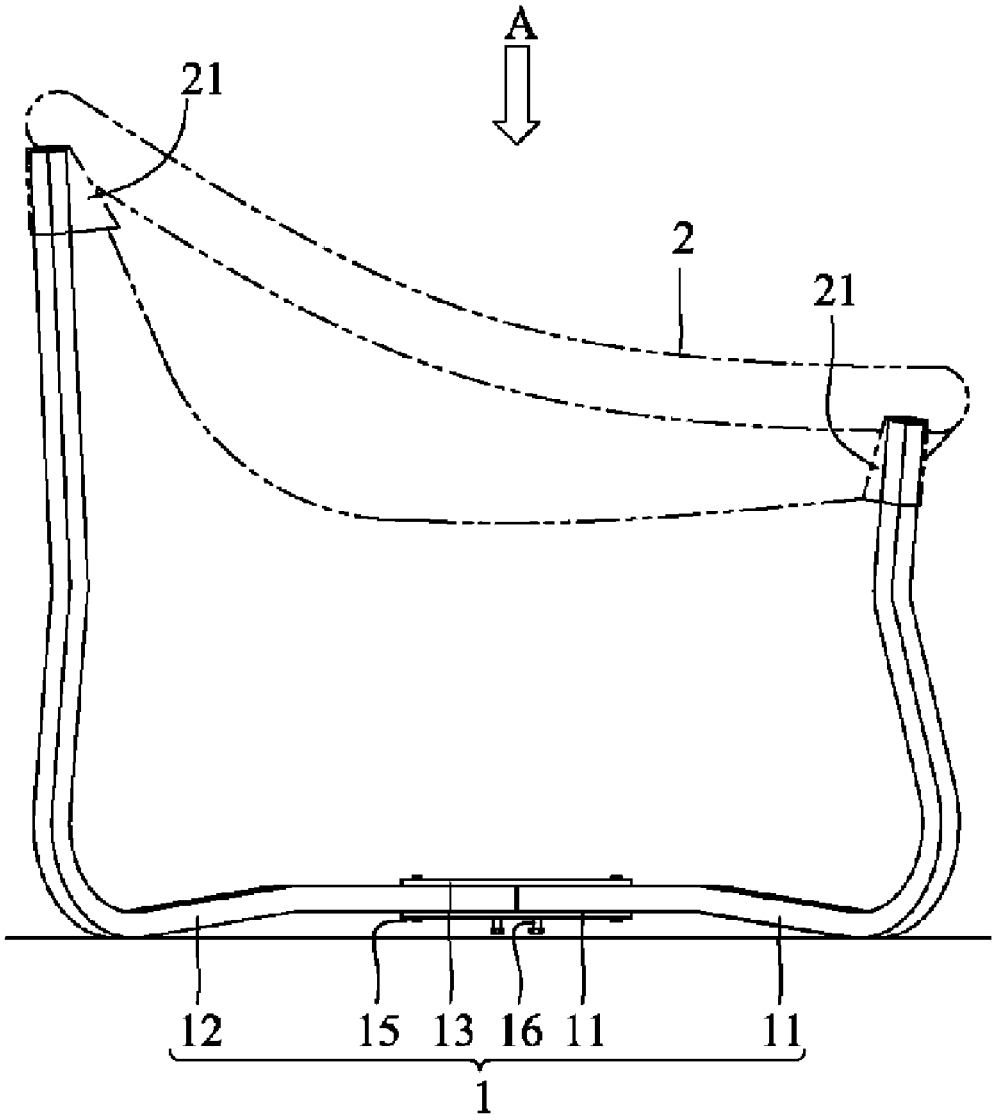
FIG. 5 is a right side view showing the unfolded condition of the leg assembly in accordance with the present invention.
Figure 11:
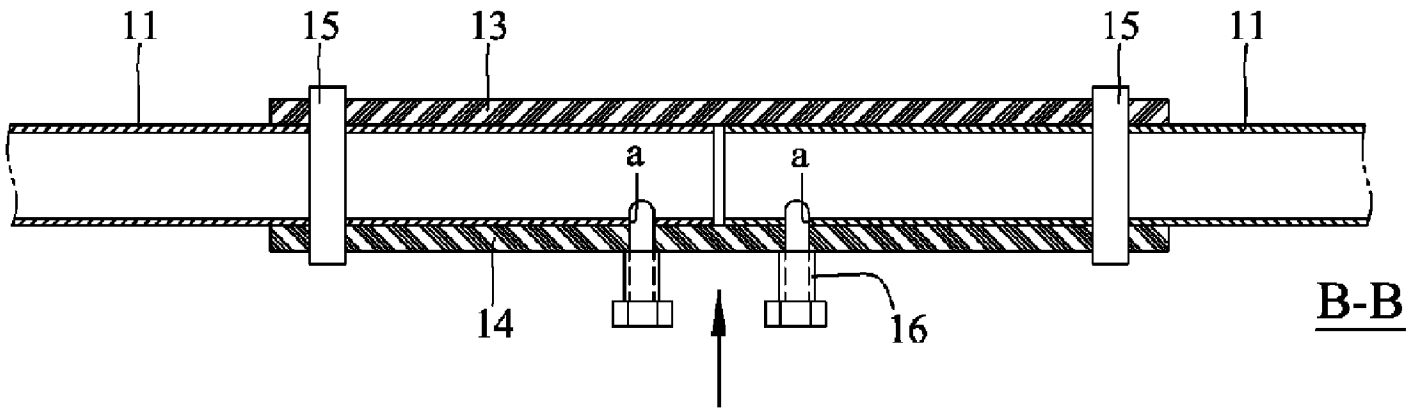
FIG. 11 is a cross section view taken along the line B—B of FIG. 6.
Figure 12:
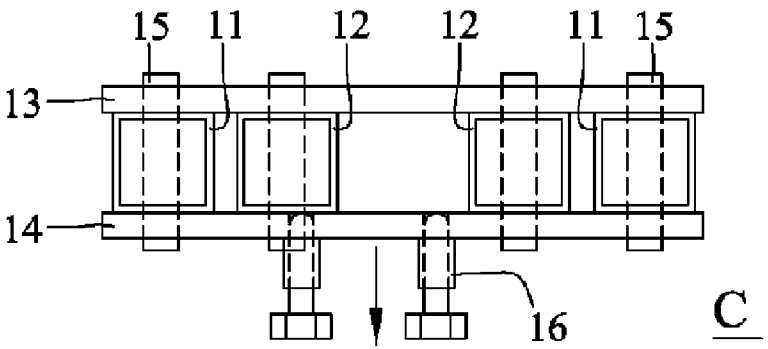
FIG. 12 is a cross section view taken along the direction C of FIG. 10.

Referring to FIGS. 4 and 5, when in an unfolded position, the inner ends of the respective locking members 16 are inserted in the corresponding holes a of the front and rear legs 11, 12, as shown in FIG. 11, so as to fix the upper and lower boards 13, 14 to the transverse ends of the front and rear legs 11, 12. The upright ends of the respective front and rear legs 11 and 12 are inserted in the assembling pockets 21 of the seat 2.

When the chair is in a folded position, the assembling pockets 21 of the seat 2 are removed from the upright ends of the respective front and rear legs 11 and 12, so that the seat 2 is removed from the leg assembly 1. After that, the locking members 16 are removed from the holes a of the front and rear legs 11 and 12, as shown in FIGS. 9–12, so that the front and rear legs 11, 12 and the upper and lower boards 13, 14 are not fixed relative to one another, as shown in FIG. 8. Then, the front legs 11 can rotate toward the two rear legs 12. Thus, the width and the length of the leg assembly 1 will be substantially reduced when the front and rear legs 11, 12 are closed together. In this way, the packaging, the storage space and the transport cost of the chair will be reduced.

To summarize, the present invention has the following advantages:

First, with the locking members 16 inserted in the holes a of the front and rear legs 11 and 12, the front and rear legs 11 and 12 can be fixed relative to one another after being unfolded, and the leg assembly 1 can stably support the seat 2.

Second, after the locking members 16 are withdrawn from the holes a of the front and rear legs 11 and 12, the front and rear legs 11, 12 and the upper and lower boards 13, 14 are not fixed relative to one another, thus, facilitating the folding operation of the chair.

Third, after the locking members 16 are withdrawn from the holes a of the front and rear legs 11 and 12, the front legs 11 can rotate and move close to the two rear legs 12. Thus, the width and the length of the leg assembly 1 will be substantially reduced. As a result, the packaging, the storage space and the transport cost of the chair will be reduced.

While we have shown and described various embodiments in accordance with the present invention, it is clear to those skilled in the art that further embodiments may be made without departing from the scope of the present invention.

What is claimed is:

1. A foldable recreational chair, comprising a leg assembly and a seat, wherein:

the leg assembly includes two front legs, two rear legs, an upper board, and a lower board, with each of the front and rear legs being pivotally mounted between the upper board and the lower board by a pivot, with each of the front and rear legs having a locking member;

the seat is made of flexible material and is arranged at four corners thereof with four assembling pockets for receiving an upright end of the respective front and rear legs;

the locking members serve to fix the upper board and the lower board to a transverse end of the respective front and rear legs, and the upright end of the respective front and rear legs is inserted in the assembling pockets of the seat.

2. The foldable recreational chair as claimed in claim 1, wherein each of the front legs is a L-shaped tube.

3. The foldable recreational chair as claimed in claim 1, wherein a hole is formed in the transverse end of the respective front legs, and each of the pivots of the front legs is inserted in the respective front legs and located adjacent to the hole.

4. The foldable recreational chair as claimed in claim 1, wherein each of the rear legs is a L-shaped tube.

5. The foldable recreational chair as claimed in claim 1, wherein a hole is formed in the transverse end of the respective rear legs, and each of the pivots of the rear legs is inserted in the respective rear legs and located adjacent to the hole.

6. The foldable recreational chair as claimed in claim 1, wherein the upper board is disposed on the transverse ends of the front and rear legs, and a top end of the respective pivot is inserted in a top surface of the upper board.

7. The foldable recreational chair as claimed in claim 1, wherein the lower board is fixed beneath the transverse ends of the front and rear legs, and a lower end of the respective pivot is inserted in a bottom surface of the lower board.

8. The foldable recreational chair as claimed in claim 1, wherein the pivots serve to pivotally connect the upper board and the lower board to the front and rear legs.

9. The foldable recreational chair as claimed in claim 1, wherein a hole is formed in each of the front and rear legs, wherein the locking members are disposed in the bottom surface of the lower board in such a manner that an end of the respective locking member is inserted in the respective hole of the front and rear legs.

* * * * *